US005497625A

United States Patent [19]

Manz et al.

[11] Patent Number: 5,497,625

[45] Date of Patent: Mar. 12, 1996

[54] THERMOELECTRIC REFRIGERANT HANDLING SYSTEM

[75] Inventors: Kenneth W. Manz, Paulding; Ilya Reyzin, Lyndhurst, both of Ohio

[73] Assignee: SPX Corporation, Muskegon, Mich.

[21] Appl. No.: 333,750

[22] Filed: Nov. 3, 1994

[51] Int. Cl.[6] ..... F25B 21/02

[52] U.S. Cl. ..... 62/3.3; 62/119; 62/292

[58] Field of Search ..... 62/292, 149, 77, 62/3.2, 3.6, 3.3

[56] References Cited

U.S. PATENT DOCUMENTS

| | | | |
|---|---|---|---|
| 4,998,413 | 3/1991 | Sato et al. | 62/292 |
| 5,090,211 | 2/1992 | Peters | 62/149 |

OTHER PUBLICATIONS

"Thermoelectric Refrigeration," Energy and Global Warming Impacts of Not-in-Kind and Next Generation CFC and HCFC Alternatives, Draft Final Report, (Chapter II), May 6, 1994.

*Primary Examiner*—John M. Sollecito

*Attorney, Agent, or Firm*—Barnes, Kisselle, Raisch, Choate, Whittemore & Hulbert

[57] ABSTRACT

A thermoelectric refrigerant handling system that includes a chamber having an inlet path for receiving refrigerant from a source thereof and an outlet for delivering refrigerant in vapor phase. A thermoelectric element is operatively disposed between the chamber and the refrigerant inlet path, and is responsive to application of electrical energy for transferring heat from the inlet path to the chamber. In this way, heat is withdrawn from refrigerant at the inlet path and refrigerant is drawn into the inlet from the source, while heat is added to refrigerant in the chamber until the refrigerant is vaporized and driven by vapor pressure through the chamber outlet. A controller applies electrical energy to the thermoelectric element for transferring heat into the chamber to vaporize the refrigerant contained therein until the chamber is substantially empty of refrigerant, and then opens a valve to feed refrigerant from the inlet path to the chamber. In this way, refrigerant is drawn from the source through the inlet, and effectively pumped in vapor phase through the outlet of the chamber.

14 Claims, 3 Drawing Sheets

THERMOELECTRIC REFRIGERANT HANDLING SYSTEM

The present invention is directed to refrigerant handling systems, and more particularly to a system in which thermoelectricity is employed for pumping refrigerant.

BACKGROUND AND SUMMARY OF THE INVENTION

It is conventional practice in systems for recovering refrigerant from equipment under service, and in other refrigerant handling systems, to employ a refrigerant compressor having an inlet that receives refrigerant through flow controls, an evaporator/accumulator and oil separator, and an outlet connected through a compressor oil separator and a condenser to the refrigerant destination, such as a storage container. U.S. Pat. Nos. 4,261,178, 4,768,347, 5,211,024 and 5,261,249, all assigned to the assignee hereof, illustrate technology of this character. A general object of the present invention is to provide a refrigerant handling system for receiving refrigerant from a source in either liquid or vapor phase, and pumping such refrigerant to an outlet for connection to a storage container or the like, in which the refrigerant compressor is eliminated, along with attendant problems associated with lubricants and moving part wear, and in which the oil separation and refrigerant pumping functions are accomplished by simplified and economical hardware. Another object of the present invention is to provide a refrigerant handling system of the subject character that is quiet in operation, and that provides reliable service over an extended operating life. A further object of the present invention is to provide a refrigerant handling system in which little or no heat is transferred to the atmosphere, and is therefore not limited by ambient temperature.

A thermoelectric refrigerant handling system in accordance with the presently preferred embodiments of the invention includes a chamber having an inlet path for receiving refrigerant from a source thereof and an outlet for delivering refrigerant in vapor phase. A thermoelectric element is operatively disposed between the chamber and the refrigerant inlet path, and is responsive to application of electrical energy for transferring heat from the inlet path to the chamber. In this way, heat is withdrawn from refrigerant at the inlet path and refrigerant is drawn into the inlet from the source, while heat is added to refrigerant in the chamber until the refrigerant is vaporized and driven by vapor pressure through the chamber outlet. A controller applies electrical energy to the thermoelectric element for transferring heat energy into the chamber to vaporize the refrigerant contained therein until the chamber is substantially empty of refrigerant, and then opens a valve to feed refrigerant from the inlet path to the chamber. In this way, refrigerant is drawn from the source through the inlet, and effectively pumped in vapor phase through the outlet of the chamber.

The system inlet path in the preferred embodiments of the invention includes a second chamber, with the thermoelectric element being operatively disposed for transferring heat energy between the chambers. In one embodiment, the inlet valve feeds refrigerant to the second chamber, and a second valve selectively feeds refrigerant from the second chamber to the first chamber. In a second embodiment, the thermoelectric element is bidirectional, being responsive to electrical energy of one state or polarity for transferring heat from the second chamber to the first, and responsive to electrical energy of another state or polarity for transferring heat energy from the first chamber to the second. The inlet valve is connected for selectively and alternating feeding inlet refrigerant to the first and second chambers, and both of the chambers have an outlet for delivering refrigerant in vapor phase. The controller operates the inlet valve in a first mode of operation to feed refrigerant to the second chamber while applying electrical energy of the one state to the thermoelectric element for withdrawing heat from refrigerant in the second chamber while vaporizing refrigerant in the first chamber until the first chamber is substantially empty of refrigerant. The controller then operates the valve in a second mode of operation to feed refrigerant from the source to the first chamber while applying electrical energy at the other state to the thermoelectric element for withdrawing heat from refrigerant in the first chamber while vaporizing refrigerant in the second chamber until the second chamber is substantially empty of refrigerant. The first and second modes of operation are repeated alternately and in sequence, such that refrigerant is pumped through the first and second chambers in parallel from the inlet to the vapor outlets of the chambers. Check valves are disposed at the vapor outlets of the chambers to prevent reverse flow of refrigerant vapor when the associated chamber is being cooled.

The refrigerant inlet control in the preferred embodiments of the invention includes a liquid refrigerant level sensor for closing the inlet valve and thereby limiting admission of refrigerant so as not to exceed capacity of the system. The chamber or chambers in which refrigerant is vaporized also have a sensor for detecting when the chamber is substantially empty of refrigerant.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
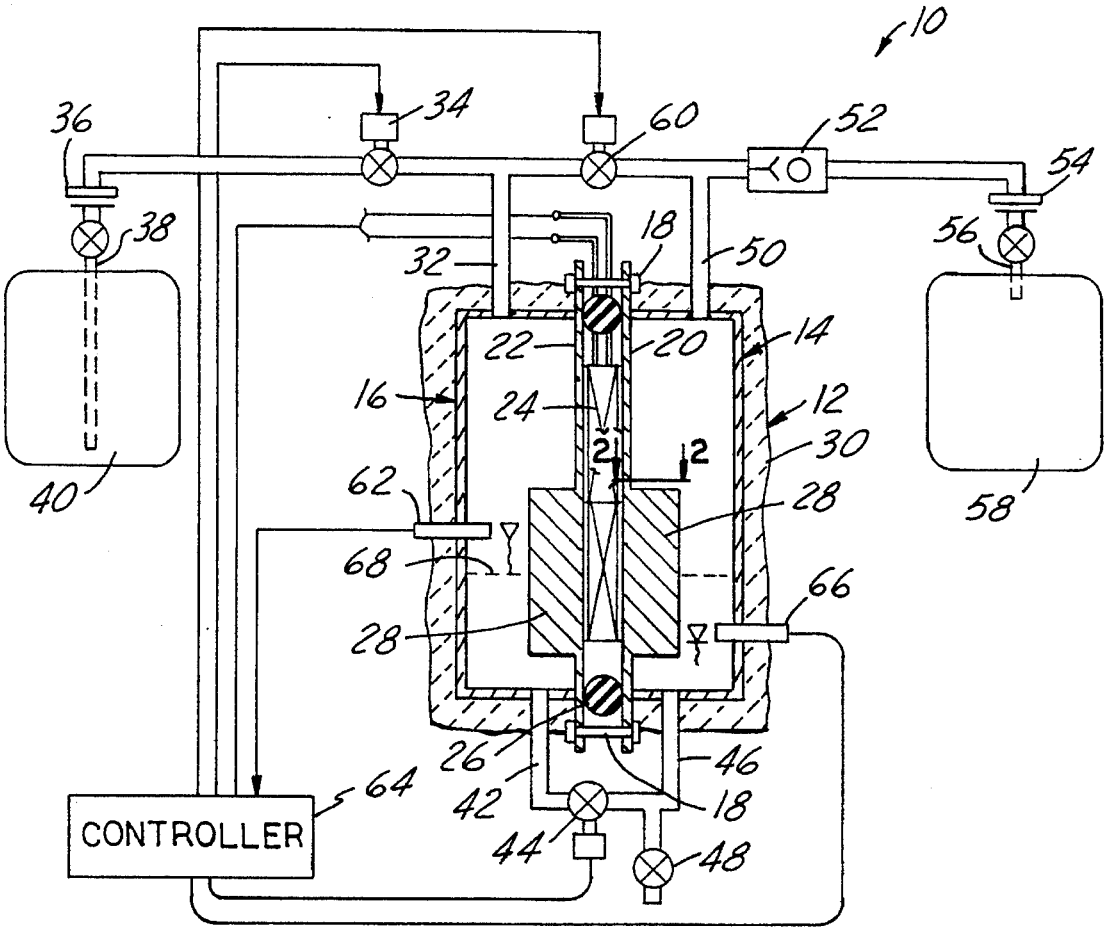
FIG. 1 is a schematic diagram of a thermoelectric refrigerant handling system in accordance with one presently preferred embodiment of the invention.
Figure 2:
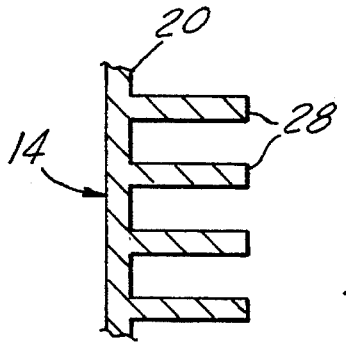
FIG. 2 is a fragmentary sectional view taken substantially along the 2—2 in FIG. 1.

FIGS. 1 and 2 illustrate a refrigerant handling system 10 in accordance with one presently preferred embodiment of the invention as comprising a closed vessel 12 having first and second closed chambers 14,16 with external flanges clamped to each other by bolts 18. Chambers 14,16 have respective flat walls 20,22 that are opposed to each other. A thermoelectric element 24 and a surrounding O-ring seal 26 are clamped between chamber walls 20,22. Seal 26 acts not only as a heat insulator, but also helps protect thermoelectric element from excessive clamping force applied by bolts 18.

Chambers 14,16 are of heat conductive construction, and thermoelectric element 24 is in heat conductive contact with chamber walls 20,22. Fins 28 integrally extend from each wall 20,22 into the associated chamber for promoting heat transfer from and to refrigerant in the chambers. Vessel 12 is surrounded by a layer 30 of insulation.

An inlet port 32 extends from the upper portion of chamber 16 through a solenoid valve 34 to a coupling 36 for connection to a source of refrigerant, such as the liquid port 38 of a refrigerant storage container 40. A port 42 at the lower portion of chamber 16 is connected through a solenoid valve 44 to a port 46 at the lower portion of chamber 14. A manual valve 48 is connected between ports 42,46 for providing facility to drain oil from vessel 12. An outlet port 50 extends from the upper portion of chamber 14 through a check valve 52 to a coupling 54 for connection to a refrigerant destination, such as the vapor port 56 of a second refrigerant storage container 58. A solenoid valve 60 is connected between inlet port 32 of chamber 16 and outlet port 50 of chamber 14. A liquid refrigerant level sensor 62 is disposed within chamber 16, and provides an electrical signal to a controller 64 when level of liquid refrigerant within chamber 16 reaches the upper portion of the chamber, and thereby approaches capacity of chamber 16. A second liquid refrigerant level sensor 66 is disposed at the lower portion of chamber 14, and provides an electrical signal to controller 64 when level of refrigerant within chamber 14 reaches the lower portion thereof, indicating that chamber 14 is substantially empty of refrigerant. Controller 64 is also connected to solenoid valves 24, 44 and 60, and to thermoelectric element 24, for controlling operation thereof, as will be described.

In operation, valve 34 is opened, and valves 44,60 are closed. Electrical energy is applied to thermoelectric element 24 for transferring heat from refrigerant within inlet chamber 16 to refrigerant within vaporization chamber 14. Inlet chamber 16 is thereby cooled, drawing refrigerant from storage container 40 (or other source of refrigerant), liquefying such refrigerant if in vapor phase and sub-cooling the refrigerant if in liquid phase. When the level of refrigerant within chamber 16 reaches sensor 62, controller 64 closes valve 34 to terminate further transfer of refrigerant to chamber 16. Valve 60 is now opened to equalize pressure between chambers 14, 16, and valve 44 is opened so that liquid refrigerant from chamber 16 flows to chamber 14 until the liquid refrigerant level is the same in both chambers—i.e., at level 68. Valves 44 and 60 are then closed, and valve 34 is opened. Transfer of heat from the refrigerant and headspace within chamber 16 to the refrigerant within chamber 14 cools chamber 22 so as to draw additional refrigerant from source 40, while at the same time heating and vaporizing refrigerant within chamber 14. When liquid refrigerant within chamber 16 rises to the level of sensor 62, valve 34 will be closed as described above. When refrigerant within chamber 14 decreases to the level of sensor 66, indicating that chamber 14 is substantially empty of refrigerant, valves 44,60 will be opened to transfer additional liquid refrigerant to chamber 14. Thermoelectric element 24 remains energized at all times until all refrigerant has been pumped from source/container 40 to destination/container 58, including refrigerant vapor remaining in container 40 after all liquid has been withdrawn.

Figure 3:
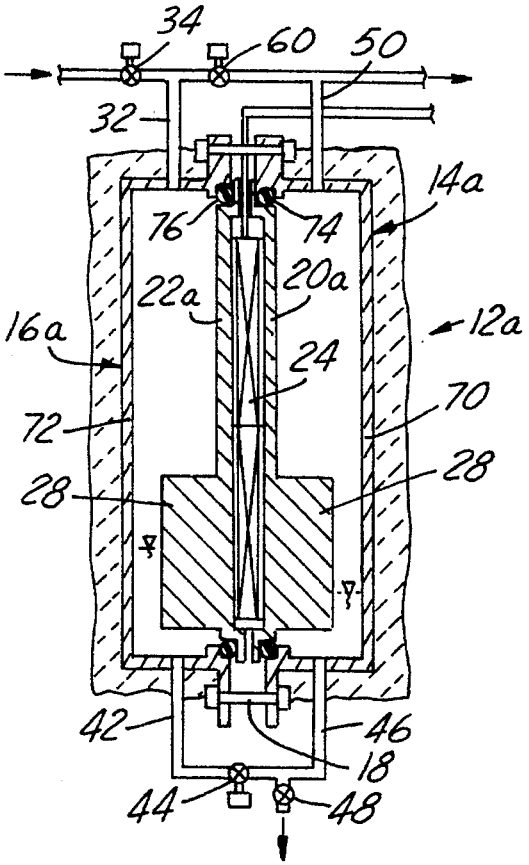
FIG. 3 is a fragmentary schematic diagram that illustrates a modification to the embodiment of FIG. 1.
Figure 4:
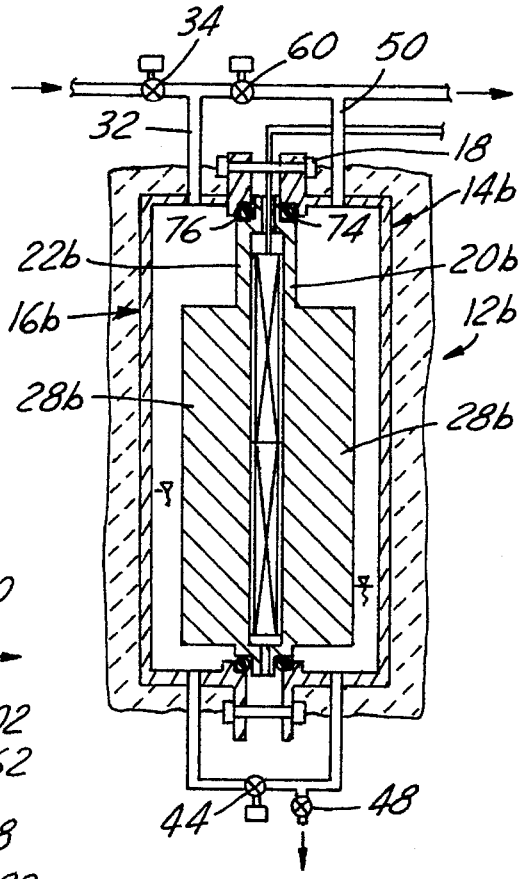
FIG. 4 is a fragmentary schematic diagram that illustrates a second modification to the embodiment of FIG. 1.

FIG. 3 illustrates a modified vessel **12*a*, in which chamber walls 20*a*,22*a* are separate from cup shaped chamber sections 70,72. Chamber sections 70,72 have flanges clamped by bolts 18. An O-ring seals 74,76 is disposed between the open edge of each chamber section 70,72 and its associated wall 20*a*,20*b*, forming sealed refrigerant chambers 14*a*,16*a*. (The O-rings also prevent excessive clamping stresses in thermoelectric element 24, as in the embodiment of FIG. 1.) Otherwise, vessel 12*a* in FIG. 3 is essentially the same as vessel 12 of FIG. 1. FIG. 4 illustrates a modified vessel 12*b* that is similar to vessel 12*a*, but vertically elongated for increasing refrigerant capacity. Opposing walls 20*b*,22*b* of chambers 14*b*,16*b* have elongated heat transfer fins 28*b***.

Figure 5:
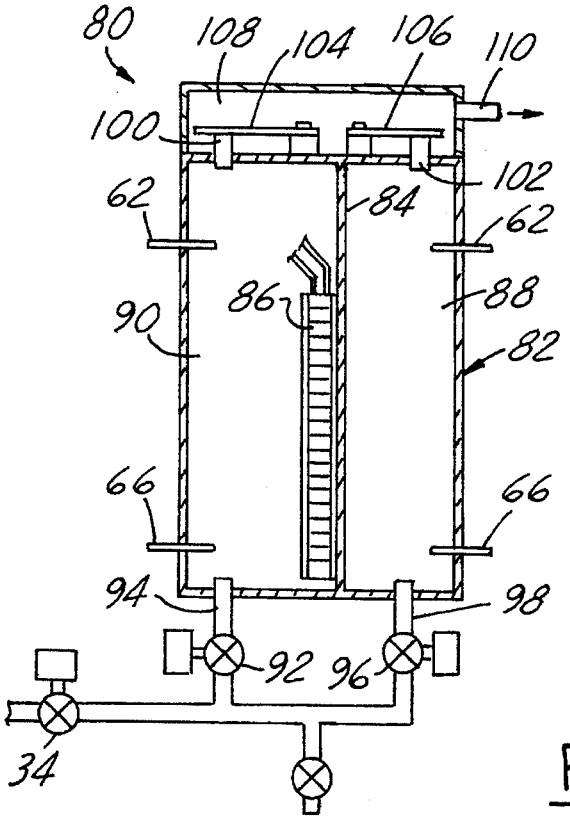
FIG. 5 is a fragmentary schematic diagram that illustrates a third modification to the embodiment of FIG. 1.

FIG. 5 schematically illustrates a modified refrigerant handling system 80 in accordance with the present invention. A closed vessel 82 has an internal wall 84 that carry a thermoelectric element 86, and for effectively dividing vessel 82 into separate first and second chambers 88,90. Thermoelectric elements 86 is a bi-directional element, which is to say that element 86 is responsive to application of electrical energy of one polarity or state to transfer heat from chamber 90 and any refrigerant contained therein to chamber 88 and any refrigerant contained therein, and to application of electrical energy of the other polarity or state for transferring heat from chamber 88 and refrigerant contained therein to chamber 90 and refrigerant contained therein. (Thermoelectric element 24 in FIG. 1 may also be of bi-directional construction, but is called upon to transfer heat energy in only one direction in that embodiment.) Inlet valve 34 is connected through a solenoid valve 92 to an inlet port 94 at the lower portion of chamber 90, and through a solenoid valve 96 to an inlet port 98 at the lower portion of chamber 88. An outlet port 100 at the upper portion of chamber 90 and an outlet port 102 at the upper portion of chamber 88 are connected through respective flapper-type check valves 104,106 to a vapor space 108 at the top of vessel 82. Vapor space 108 has an outlet port 110 for connection to a refrigerant destination, such as storage container 58 in FIG. 1. A pair of low liquid refrigerant level sensors 66 are disposed in respective chambers 88,90, as are a pair of high liquid refrigerant level sensors 62.

In operation of the embodiment of FIG. 5, each of the chambers 88,90 operates in alternate modes of operation as a liquid refrigerant inlet chamber and a refrigerant vaporization chamber. That is, assume that chamber 88 is filled with liquid refrigerant up to the level of sensor 62, and chamber 90 has liquid refrigerant only to the level of associated sensor 66. Valves 34 and 92 are opened by controller 64 (FIG. 1), valve 96 is closed, and thermoelectric element 86 is energized at a polarity or state to transfer heat from chamber 90 to chamber 88. Decreasing temperature within chamber 90 draws refrigerant into the chamber through valves 26,92, until liquid refrigerant within chamber 90 reaches the level of sensor 62, at which point valve 92 is closed. In the meantime, vaporization of refrigerant within chamber 88 causes such refrigerant to be expelled through outlet 102 and check valve 106 to vapor space 108 and outlet 110. This vaporization continues until refrigerant within chamber 88 reaches the level of sensor 66, at which point polarity of electrical energy applied to thermoelectric element 86 is reversed, and valve 96 is opened to admit refrigerant to chamber 88 as chamber 88 cools. In the meantime, refrigerant within chamber 90 is now heating and vaporizing, so that the same will be expelled through outlet port 100 and check valve 104 until such time as the refrigerant reaches the level of sensor 66. Thus, the embodiment of FIG. 5 differs from the embodiment of FIG. 1 in that both chambers 88,90 in FIG. 5 are alternately used as cooling and vaporization chambers, as distinguished from the embodiment of FIG. 1 in which chamber 16 is strictly a cooling chamber and chamber 14 is strictly a vaporization chamber.

Figure 6:
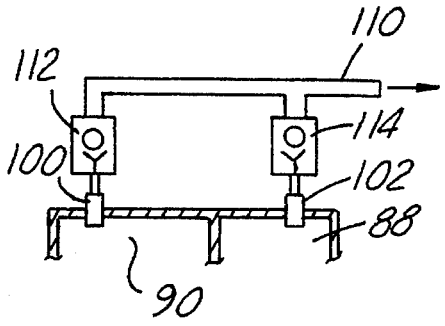
FIG. 6 is a fragmentary schematic diagram that illustrates a modification to the embodiment of FIG. 5.

FIG. 6 illustrates a modification to the embodiment of FIG. 5 in which type flapper-type check valves 104,106 in FIG. 5 are replaced by ball-type check valves 112,114 in FIG. 6, and vapor space 108 is eliminated.

Figure 7:
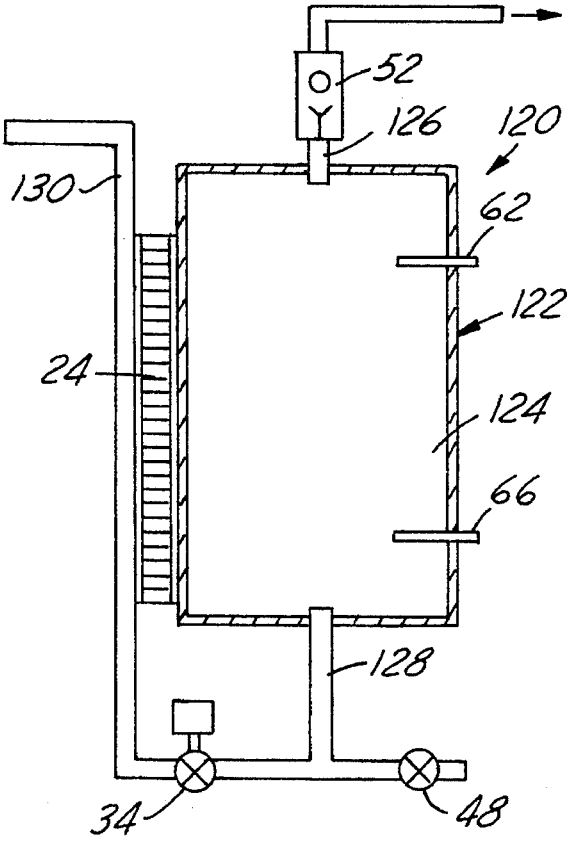
FIG. 7 is a fragmentary schematic diagram that illustrates a fourth modification to the embodiment of FIG. 1.

FIG. 7 illustrates a refrigerant handling system 120 in accordance with another embodiment of the invention. A closed vessel 122 forms a chamber 124 having an outlet port 126 at the upper end thereof connected through check valve 52 to the refrigerant destination, such as container 58 in FIG. 1. An inlet port 128 at the lower portion of chamber 124 is connected through inlet solenoid valve 34 to a conduit 130 that extends closely adjacent to a sidewall of chamber 124. Thermoelectric element 24 (or 86) is disposed between conduit 130 and chamber 124, and is responsive to application of electrical energy for transferring heat from conduit 130 and refrigerant contained therewithin to chamber 124 and refrigerant contained therewithin. In operation, valve 34 is opened until liquid refrigerant fills chamber 124 to the level of sensor 62. Valve 34 is then closed, and heat transfer through thermoelectric element 24 heats and vaporizes refrigerant within chamber 124, while at the same time cooling conduit 130 and drawing refrigerant from the refrigerant source. When refrigerant within chamber 124 decreases to the level of sensor 66, solenoid valve 34 is again opened, admitting liquid refrigerant up to the level of sensor 62. This operation continues until all desired refrigerant has been transferred from the source (e.g., container 40 in FIG. 1) to the destination (e.g., container 58 in FIG. 1).

We claim:

1. A thermoelectric refrigerant handling system that comprises:

a first chamber having inlet means for receiving refrigerant from a source thereof and an outlet for delivering refrigerant in vapor phase, said inlet means including valve means for selectively connecting said inlet means to said first chamber, thermoelectric means operatively disposed between said first chamber and said inlet means, and responsive to application of electrical energy for transferring heat from said inlet means to said first chamber, thereby withdrawing heat from refrigerant in said inlet means and adding heat to refrigerant in said first chamber, and control means for applying electrical energy to said thermoelectric means for transferring heat energy into said first chamber to vaporize refrigerant contained therein until said first chamber is substantially empty of refrigerant, and then opening said valve means to feed refrigerant from said inlet means to said first chamber.

2. The system set forth in claim 1 wherein said inlet means comprises a second chamber, said thermoelectric means being operatively disposed for transferring heat energy between said first and second chambers.

3. The system set forth in claim 2 wherein said valve means is connected to feed refrigerant to said second chamber, and from said second chamber to said first chamber when said first chamber is substantially empty of refrigerant.

4. The system set forth in claim 2 wherein said valve means is connected for selectively and alternately feeding refrigerant to said first and second chambers, wherein said thermoelectric means comprises bi-directional thermoelectric means responsive to application of electrical energy of one state for transferring heat energy from said second chamber to said first chamber and of another state for transferring heat energy from said first chamber to said second chamber, both of said chambers having an outlet for delivering refrigerant in vapor phase, and wherein said control means comprises means for operating said valve means in a first mode of operation to feed refrigerant to said second chamber while applying electrical energy of said one state to said thermoelectric means for withdrawing heat from refrigerant in said second chamber and adding test heat to refrigerant in said first chamber until said first chamber is substantially empty of refrigerant, then operating said valve means in a second mode of operation to feed refrigerant to said first chamber while applying electrical energy of said other state to said thermoelectric means for withdrawing heat from refrigerant in said first chamber while adding heat to refrigerant in said second chamber until said second chamber is substantially empty of refrigerant, and reverting to said first mode of operation such that said second and first chambers operate as part of such inlet means in said first and second modes of operation respectively.

5. The system set forth in claim 4 further comprising a check valve of said outlet of each of said first and second chambers for preventing reverse flow of refrigerant through said outlets when the associated chamber is cooled by said thermoelectric means.

6. The system set forth in claim 2 wherein said inlet means further comprises means operatively coupled to said second chamber for sensing when said second chamber is substantially full of refrigerant.

7. The system set forth in claim 1 further comprising means for selectively draining oil from a lower portion of said first chamber.

8. The system set forth in claim 1 further comprising means operatively coupled to said first chamber for sensing when said first chamber is substantially empty of refrigerant.

9. The system set forth in claim 1 further comprising means for limiting admission of refrigerant through said inlet means so as not to exceed capacity of said first chamber.

10. A thermoelectric refrigerant handling system that comprises:

a first chamber having an outlet for delivering refrigerant in vapor phase, inlet means for receiving refrigerant from a source thereof, said inlet means including valve means for selectively feeding refrigerant from said inlet means to said first chamber, and first sensor means for sensing quantity of refrigerant and closing said valve means when such quantity reaches capacity of said system, thermoelectric means operatively disposed between said first chamber and said inlet means, and responsive to application of electrical energy for transferring heat energy for said inlet means to said first chamber, so as to withdraw heat from refrigerant in said inlet means and thereby draw refrigerant into said inlet means from the source, while adding heat to and vaporizing refrigerant in said first chamber and thereby propelling refrigerant vapor from said first chamber through said outlet, second sensor means for sensing when said first chamber is substantially empty of refrigerant, and control means operatively coupled to said valve means and said thermoelectric means, and responsive to said first and second sensor means, for applying electrical energy to said thermoelectric means, opening said valve means responsive to said second sensor means to feed refrigerant to said first chamber, and closing said valve means responsive to said first sensor when capacity of said system is reached, thereby to pump refrigerant from the source to said outlet.

11. The system set forth in claim 10 wherein said inlet means comprises a second chamber, said thermoelectric means being operatively disposed for transferring heat energy between said first and second chambers.

12. The system set forth in claim 11 wherein said first and second chambers have respective flat walls disposed in opposition to each other, and wherein said thermoelectric means is disposed between said walls, in heat transfer contact with said walls, and physically isolated by said walls from refrigerant within said chambers.

13. The system set forth in claim 12 further comprising means for clamping said chambers to each other with said thermoelectric means sandwiched therebetween.

14. The system set forth in claim 13 further comprising resilient means for limiting force applied to said thermoelectric means by said clamping means.

* * * * *